United States Patent [19]

Nolley, Jr.

[11] 4,019,979

[45] Apr. 26, 1977

[54] FRACTIONATION OF HYDROCARBONS

[75] Inventor: John P. Nolley, Jr., Glendale Heights, Ill.

[73] Assignee: UOP Inc., Des Plaines, Ill.

[22] Filed: Mar. 19, 1976

[21] Appl. No.: 668,545

[52] U.S. Cl. ..... 208/353; 196/132; 208/102; 208/354

[51] Int. Cl.[2] ..... C10G 7/00

[58] Field of Search ..... 208/102, 103, 104, 353, 208/354, 355

[56] References Cited

UNITED STATES PATENTS

| | | | |
|---|---|---|---|
| 2,130,988 | 9/1938 | Roberts | 208/353 |
| 3,494,861 | 2/1970 | Munro | 208/353 |

*Primary Examiner*—Herbert Levine
*Attorney, Agent, or Firm*—James R. Hoatson, Jr.; Robert W. Erickson; William H. Page, II

[57] ABSTRACT

A process for the fractionation of hydrocarbons which includes the steps of extracting heat from a liquid sidecut stream, splitting the sidecut stream into two portions, splitting the liquid stream formed by condensing the overhead vapor stream into two portions, admixing one of the portions of the sidecut stream with one of the portions of the overhead liquid stream to form the reflux to the fractionation column, and admixing the other portion of each stream to form a product stream.

1 Claim, 1 Drawing Figure

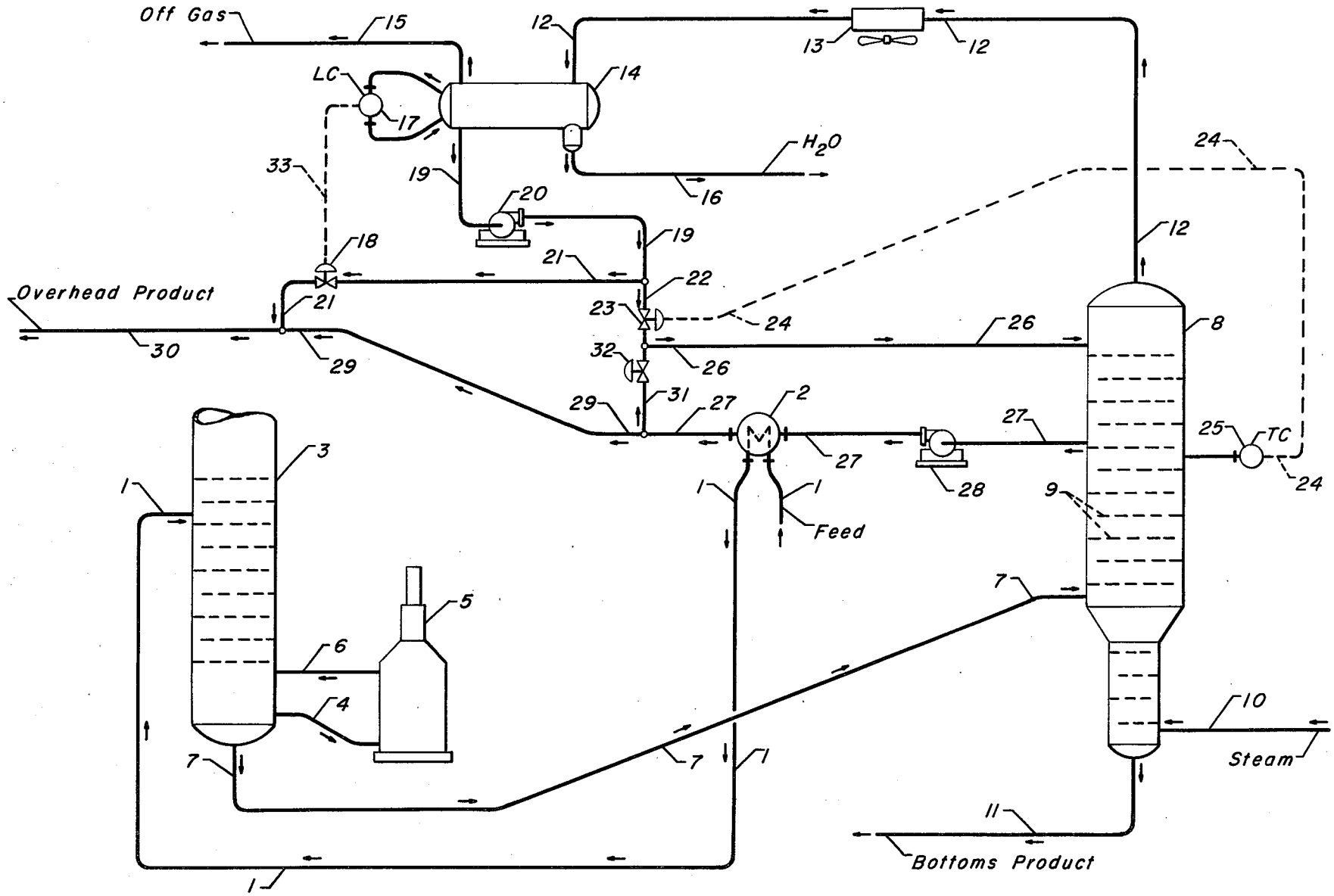
Steam
Bottoms Product
Feed
Off Gas
Overhead Product
$H_2O$
TC
LC

FRACTIONATION OF HYDROCARBONS

FIELD OF THE INVENTION

The invention relates to a method of fractionating mineral oils such as found in Class 208–308 or 208–353. The invention also relates to a separatory distillation process such as found in Class 203–21.

DESCRIPTION OF THE PRIOR ART

Fractionation is one of the oldest and most developed areas of petroleum and petrochemical processing. Accordingly, the knowledge needed to design, manufacture and operate fractionation columns and their accouterments is possessed by those skilled in the art and is available from a great many references. Included within the prior art are the use of reflux at a rate determined by a temperature measurement taken at an intermediate point in the fractionation column, the removal of a liquid sidecut from the column and the removal of heat from the sidecut stream by indirect heat exchange. This is illustrated by U.S. Pat. Nos. 2,357,113 (Cl. 196–132); 2,134,836 (Cl. 196–11); 3,819,511 (Cl. 208–353) and 3,798,153 (Cl. 208–4-8AA). These references also show that it is known to withdraw a portion of the sidecut stream as a product and to return a portion of the cooled sidecut stream to the column at a point above the sidecut drawoff tray.

BRIEF SUMMARY OF THE INVENTION

The present invention is distinguished from the prior art in that heretofore separate portions of a sidecut stream have not been combined with corresponding portions of the overhead liquid to form a single reflux stream and also to form the net product stream removed from the top section of the column. By the process of the invention usable heat is removed from the sidecut stream by indirect exchange, and the mean temperature difference available for the exchange may be controlled by regulating the circulation rate of the sidecut stream. A broad embodiment of the invention may be described as a fractionation process which comprises the steps of separating the liquid hydrocarbon stream formed by condensing the column's overhead vapors into two portions, withdrawing a sidecut stream from the column and removing heat from the sidecut stream by indirect heat exchange, dividing the sidecut stream into two portions, and combining a corresponding portion of each stream to form a reflux stream and a product stream.

DESCRIPTION OF THE DRAWING

The drawing shows a diagram of the preferred embodiment, which for the purposes of simplicity and clarity does not illustrate many of the numerous small items needed for successful operation. Many control systems, pumps, valves, etc. are therefore not shown. For purposes of the description, it is assumed the invention is used on a rerun column which is removing a stream of distillate from the bottoms stream of the product fractionation column of a heavy oil hydroprocessing unit. This is not intended to limit the invention to this specific configuration or mode of operation.

The feed stream to the fractionation zone, in this case the effluent of the hydroprocessing unit, enters through line 1 and is heat exchanged in means 2 against a sidecut stream passing through line 27. The feed stream is then passed into a product fractionation column 3 which removes a sizable portion of the lighter components overhead. A first stream of bottoms material is removed in line 4 and partially vaporized in a reboiler means 5 and then returned to the column via line 6. A second stream of bottoms material is removed as the net bottoms product in line 7 and passed into an intermediate point of the rerun column 8. This stream is subjected to further fractional distillation on trays 9 promoted by the addition of steam entering in line 10.

The rerun column functions as a splitter to produce a net bottoms product removed in line 11 and a net overhead product removed in line 30. An overhead vapor stream leaves the top of the column in line 12, and substantially all of the normally liquid hydrocarbons in this stream are condensed by the action of a cooling means 13. The resultant mixed phase material continues through line 12 into an overhead receiver 14. The normal separatory processes produce a stream of water which is removed in line 16 and an off-gas stream comprising light gases and inerts which is removed through line 15. The remaining hydrocarbon material is withdrawn through line 19 and pressurized by a pump 20. A first portion of this material flows through line 22 at a rate controlled by a flow control means 23. This flow control means is actuated by a signal carried by means 24 from a temperature control means 25, which measures a fluid temperature at an intermediate point in the column. A second portion of the stream in line 19 is diverted into line 21 at a rate controlled by a flow control means 18. This flow control means is actuated through means 33 in response to a signal generated by a level control means 17.

A liquid sidecut stream is removed from column 8 through line 27. This stream is pressurized in a pump 28 and then cooled by heat exchange with the material in line 1. The sidecut stream is then divided into a first portion carried in line 31 at a rate controlled by flow control means 32 and a second portion passed through line 29. The first portion of the stream of condensed material is admixed with the first portion of the sidecut stream and passed into the column as the reflux stream carried by line 26. The remaining second portions of each of these streams are also admixed to form a product stream removed from the column in line 30.

DETAILED DESCRIPTION AND EXAMPLE

It is normally desirable to recover usable heat from a fractionation column by the indirect heat exchange of various product streams with fluids which it is desired to raise in temperature or to vaporize. Heat is therefore often recovered by exchanging the bottoms product stream, the overhead product stream and sidecut streams. Heat is also removed from various intermediate sections of a column to adjust or control vapor flow rates and to condense overhead vapors. Those skilled in the art are well versed in design of both the equipment and processes for these heat recovery steps. The subject invention is an improvement in the manner in which heat may be removed from the upper portion of a fractionation column using the equipment of the prior art.

Heat can be removed from an intermediate point of a fractionation column by heat exchange against either the vapor phase or the liquid phase present within the column. In either case, certain limitations are imposed on the amount of heat which may be removed without upsetting the operation of the column. In addition, the maximum amount of heat which can be removed is limited by the minimum mean temperature difference between the two fluids which must exist in order for an indirect heat exchange to be practical. When a liquid stream is removed as a sidecut and heat exchanged, the combination of its flow rate and its temperature often limit the heat which can be removed to a quantity below that which can be removed without disturbing the operation of the column and which it is desired to remove. It is an objective of the invention to increase the amount of heat which may be removed by indirect heat exchange of a sidecut stream. It is a further objective to provide a method of regulating the mean temperature difference in the heat exchange means in which the sidecut stream is cooled.

These and other objectives are achieved through a process which comprises the step of splitting the sidecut stream into two portions after it has been heat exchanged and returning one of the portions to the column as part of the reflux stream. The portion returned as reflux is heated within the column by admixture with the warmer vapor and liquid as its heavier components descend through the column. At least some of this heating will be by the removal of heat of vaporization by direct heat exchange with rising vapors. The part of the column above the sidecut drawoff tray therefore functions as a contact condensing means which is used to remove heat from the column.

As the subject method is not affected by the composition of the sidecut stream, the invention is one of general application. It may be applied to a wide variety of petroleum and petrochemical separations. The invention may be advantageously applied when it is desired to remove dissolved volatile materials from the feed stream simultaneously with its fractionation. Examples of this are the removal of dissolved nitrogen or hydrogen from liquids being drawn from blanketed storage and the removal of light hydrocarbons formed by thermocracking which occurs to a limited degree in many high temperature operations. The sidecut stream may comprise a relatively pure organic compound such as a xylene, benzene or ethylbenzene, or it may be a petroleum derived mixture including naphtha fractions, kerosenes, vacuum gas oils, cycle oils, normally gaseous hydrocarbons, etc. The column may therefore be operated at pressures ranging from subatmospheric to about 1000 psig. and with a bottoms liquid temperature of from about 100° to about 800° F. The subject method is also not restricted to specific configurations within the column, and the trays used may be of any of the many types known in the art. The invention is however limited in that the sidecut stream must be withdrawn at an intermediate point of the column and that the feed stream must be charged to a lower intermediate point of the column. The sidecut stream is removed above the feed point to avoid contamination of the product stream derived from it with the components of the feed stream desired in the bottoms product. As used herein, the term "intermediate point" is intended to refer to a point in a column which is below two or more fractionation trays and also above two or more trays. Unless otherwise specified, it is intended that all other terminology should have a meaning similar to that understood by those skilled in the art of petroleum refining.

As a second step in the invention the liquid hydrocarbon stream removed from the overhead receiver of the column is also divided into two portions. A first portion of this stream is combined with that portion of the sidecut stream which is to be returned to the column as reflux. The remaining second portion of the overhead liquid hydrocarbon stream is combined with the remaining second portion of the sidecut stream and the composite stream is removed as a product stream. As used herein, the term "first portion" of either the overhead liquid stream or the sidecut material is intended to refer to the amount of such stream which is returned to the column as reflux. Accordingly, any reference to the "second portion" of either of these two streams is intended to indicate the amount which is removed as a product stream.

A bottoms product stream is also removed from the column. The column therefore functions as a splitter column, and the sidecut stream is not removed as an intermediate product stream. Instead, the sidecut stream functions both as a joint source of the top product stream and as a means of heat removal from an upper portion of the column. One of the main advantages of this is that it allows adjustments in the mean temperature differential across a heat exchange means by varying the circulation rate of the sidecut stream. The changes in column operation which result from this heat removal are then compensated for by adjustments in the reflux rate and the amount of overhead material used as reflux. A second advantage of the invention is that the sidecut stream is warmer than the overhead vapors, thereby providing a greater temperature differential and more efficient heat exchange.

An additional advantage which is present when the feed stream is being steam stripped is that the resultant top product of the column is drier than a top product stream drawn from an overhead receiver. This results from the sidecut material being much drier than the overhead liquid which is in equilibrium with liquid water at a relatively low temperature. Other advantages also reside in the higher temperature of the sidecut material. For instance, it is reasonably expected that even after the heat exchange the sidecut stream will be warmer than the condensed overhead material, which must be cooled sufficiently to condense the water vapor. The combined top product stream will therefore be warmer than a product stream containing only overhead liquid. This is an advantage when a high temperature product is desired. The invention also reduces the amount of cooling required in the overhead condenser used on the column.

The percentage of each stream which forms either portion may vary widely, and the first portion of each stream may therefore be between 10 and 80 percent of the total stream. Preferably each portion is between 30 and 70 percent. The actual percentages chosen will be set by several factors including product specifications and heat exchange efficiencies in both the sidecut exchanger and the overhead condenser. The flow rate of the sidecut stream at its point of withdrawal will be the sum of the amount of the sidecut material which it is desired to remove in the net product stream and the amount which is to be recirculated. The necessary recirculation rate is adjusted to allow removal of the amount of heat which it is desired to remove from the material passing through the heat exchange means. The flow rate of the first portion of the sidecut stream is therefore increased as needed to increase the temperature differential or flow rate in the heat exchange means.

The rate of removal of the total sidecut stream is preferably controlled in response to a temperature measurement related to the heat exchange means into which the sidecut stream is passed. This may be a measurement of the temperature of one of the effluent streams, the mean temperature difference, etc. The sidecut stream may also be run on flow control. The rate of removal of the sidecut stream can be controlled in several different ways. Referring now to the drawing, a flow control means may be located in line 27 to regulate the entire flow at one point. As an alternative to this a flow control means located in line 29 may be used to regulate the sidecut stream in a manner which adjusts for the amount passing through line 31.

The rate of flow of the reflux stream may be varied by a control valve controlling either the total reflux stream, the portion of the condensed overhead liquid fed into the total reflux stream or the portion of the sidecut liquid stream which is used as reflux. Preferably, a temperature measurement taken at an intermediate point in the column is used to control the return of the condensed overhead liquid to the column. The rate of flow of the second portion of the overhead liquid stream is preferably regulated by a level control means used in the overhead receiver. The rate of flow of the second portion of the sidecut material is preferably set at some constant rate. The relative percentage in each portion will therefore vary with time. Those skilled in the art will recognize that a wide variety of control systems may be adapted to operate the invention in the manner described.

In accordance with the preceding description, the preferred embodiment of the invention may be characterized as a process for fractionating hydrocarbons which comprises the steps of passing a feed stream into a fractionation column at a first intermediate point while the fractionation column is operated at conditions effective to cause the fractionation of the feed stream; withdrawing a bottoms product stream from the fractionation column; withdrawing an overhead vapor stream from the fractionation column, passing the overhead vapor stream through a condensing means, and passing a resultant mixed phase hydrocarbon stream into an overhead receiver; removing a liquid hydrocarbon stream from the overhead receiver and dividing the liquid hydrocarbon stream into a first aliquot portion and a second aliquot portion; removing a liquid sidecut stream from the fractionation column at a second intermediate point located above the first intermediate point; heat exchanging the liquid sidecut stream and effecting the removal of heat therefrom, and dividing the liquid sidecut stream into a first aliquot portion and a second aliquot portion; admixing the first portion of the liquid hydrocarbon stream with the first portion of the liquid sidecut stream, and passing the resultant admixture into the fractionation column as a reflux stream; and, admixing the second portion of the liquid hydrocarbon stream with the second portion of the liquid sidecut stream and removing the resultant admixture as a product stream of the fractionation column.

To ensure a complete understanding of the invention concept an example based upon the design for a unit similar to the system illustrated in the drawing is given below. The feed to the rerun column is a predominately vapor phase stream of about 1133 mols/hr. having a temperature of about 684° F., a pressure of 10 psig. and an average molecular weight of 258. This feed stream falls onto the fifteenth tray from the top of the column. About 2,170 lbs./hr. of 185 psig. steam is injected into the bottom of the column under the twentieth tray. A net bottoms product comprising about 132 mols/hr. of a 41.0 °API liquid is removed at approximately 634° F. The overhead vapor stream comprises about 1121 mols/hr. having an average molecular weight of 132 and a temperature of 480° F. at 8 psig.

The overhead vapor stream is cooled to close to 130° F. and separated. This yields a 47.5 °API liquid hydrocarbon stream removed from the overhead receiver at a rate of about 1000 mols/hr. A sidecut stream is removed from a trap on the fifth tray at a temperature of 550° F. and cooled to approximately 400° F. as the result of heat exchange with the feed to the product fractionation column. This stream is then split into two portions. A first portion comprising about 694 mols/hr. of this 40.5 °API liquid is combined with a first portion of the condensed liquid hydrocarbon stream to form a 1,138 mols/hr. reflux stream. This 42.9 °API reflux stream is fed to the top tray at about 315° F. The amount of the total reflux stream and preferably of the condensed liquid stream used to form it will of course vary with temperature conditions within the column. The remaining 445 mols/hr. of the sidecut stream is cooled and admixed with the remaining portion of the condensed hydrocarbon stream to form a 44.0 °API net product stream removed at about 1,001 mols/hr.

I claim as my invention:

1. A process for fractionating hydrocarbons which comprises the steps of:

a. passing a feed stream into a fractionation column at a first intermediate point while the fractionation column is operated at conditions effective to cause the fractionation of the feed stream;

b. withdrawing a bottoms product stream from the fractionation column;

c. withdrawing an overhead vapor stream from the fractionation column, passing the overhead vapor stream through a condensing means, and passing a resultant mixed phase hydrocarbon stream into an overhead receiver;

d. removing a liquid hydrocarbon stream from the overhead receiver and dividing the liquid hydrocarbon stream into a first aliquot portion and a second aliquot portion;

e. removing a liquid sidecut stream from the fractionation column at a second intermediate point located above the first intermediate point;

f. heat exchanging the liquid sidecut stream and effecting the removal of heat therefrom, and dividing the liquid sidecut stream into a first aliquot portion and a second aliquot portion;

g. admixing the first portion of the liquid hydrocarbon stream with the first portion of the liquid sidecut stream, and passing the resultant admixture into the fractionation column as a reflux stream; and, h. admixing the second portion of the liquid hydrocarbon stream with the second portion of the liquid sidecut stream and removing the resultant admixture as a product stream of the fractionation column.

* * * * *